US005269231A

United States Patent [19]

Johnson

[11] Patent Number: 5,269,231

[45] Date of Patent: Dec. 14, 1993

[54] SHELF APPARATUS

[76] Inventor: John I. Johnson, 35416 Raigosa/Cheltham, Newberry Springs, Calif. 92365

[21] Appl. No.: 864,561

[22] Filed: Apr. 7, 1992

[51] Int. Cl.[5] ..... A47B 85/00

[52] U.S. Cl. ..... 108/23; 108/94; 108/103

[58] Field of Search ..... 108/23, 93, 94, 103, 108/104, 105, 152, 139

[56] References Cited

U.S. PATENT DOCUMENTS 793,451 6/1905 Lindsay et al. ..... 108/103

2,540,353 2/1951 Schick ..... 108/23

3,415,570 12/1968 Mosley et al. ..... 108/23

3,538,862 11/1970 Patriarca ..... 108/94

*Primary Examiner*—James R. Brittain

*Assistant Examiner*—Gerald A. Anderson

*Attorney, Agent, or Firm*—Leon Gilden

[57] ABSTRACT

A central tubular post pivotally mounts respective right and left shelf plates orthogonally relative to the central post, with the right and left shelf plates having orthogonally and fixedly directed therethrough respective right and left post members. A modification of the invention includes a mounting structure relative to the right and left shelves, as well as auxiliary illumination structure.

5 Claims, 4 Drawing Sheets

SHELF APPARATUS

BACKGROUND OF THE INVENTION

1. Field of the Invention

The field of invention relates to shelf apparatus, and more particularly pertains to a new and improved shelf apparatus wherein the same is arranged for the shelf structure to accommodate free-standing or variously configured wall surfaces.

2. Description of the Prior Art

Shelf structure of various types are utilized throughout the Prior art. The instant invention attempts to overcome deficiencies of the Prior art by providing for a shelf structure arranged for accommodation of various wall structures and configurations. Adjustable shelf structure is set forth in U.S. Pat. No. 4,852,501 to Olson, et al. wherein shelves are arranged for vertical adjustment relative to one another.

U.S. Pat. No. 4,674,723 to Bayuk sets forth bracket structure arranged for vertically mounting shelves to a wall surface.

Similarly, U.S. Pat. No. 4,716,841 sets forth a similar type organization.

As such, it may be appreciated that there continues to be a need for a new and improved shelf apparatus as set forth by the instant invention which addresses both the Problems of ease of use as well as effectiveness in construction and in this respect, the Present invention substantially fulfills this need.

SUMMARY OF THE INVENTION

In view of the foregoing disadvantages inherent in the known types of shelf apparatus now present in the prior art, the present invention provides a shelf apparatus wherein the same is arranged to permit angular orientation of shelf pairs relative to one another. As such, the general purpose of the present invention, which will be described subsequently in greater detail, is to provide a new and improved shelf apparatus which has all the advantages of the prior art shelf apparatus and none of the disadvantages.

To attain this, the present invention provides a central tubular post pivotally mounting respective right and left shelf plates orthogonally relative to the central post, with the right and left shelf plates having orthogonally and fixedly directed therethrough respective right and left post members. A modification of the invention includes a mounting structure relative to the right and left shelves as well as auxiliary illumination structure.

My invention resides not in any one of these features per se, but rather in the Particular combination of all of them herein disclosed and claimed and it is distinguished from the prior art in this Particular combination of all of its structures for the functions specified.

There has thus been outlined, rather broadly, the more important features of the invention in order that the detailed description thereof that follows may be better understood, and in order that the Present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the Present invention. It is important, therefore, that the claims be regarded as including such equivalent constructions insofar as they do not depart from the spirit and scope of the Present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved shelf apparatus which has all the advantages of the prior art shelf apparatus and none of the disadvantages.

It is another object of the present invention to provide a new and improved shelf apparatus which may be easily and efficiently manufactured and marketed.

It is a further object of the present invention to provide a new and improved shelf apparatus which is of a durable and reliable construction.

An even further object of the present invention is to Provide a new and improved shelf apparatus which is susceptible of a low cost of manufacture with regard to both materials and labor, and which accordingly is then susceptible of low prices of sale to the consuming Public, thereby making such shelf apparatus economically available to the buying public.

Still yet another object of the present invention is to provide a new and improved shelf apparatus which provides in the apparatuses and methods of the Prior art some of the advantages thereof, while simultaneously overcoming some of the disadvantages normally associated therewith.

These together with other objects of the invention, along with the various features of novelty which characterize the invention, are Pointed out with Particularity in the claims annexed to and forming a Part of this disclosure. For a better understanding of the invention, its operating advantages and the specific objects attained by its uses, reference should be had to the accompanying drawings and descriptive matter in which there is illustrated Preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
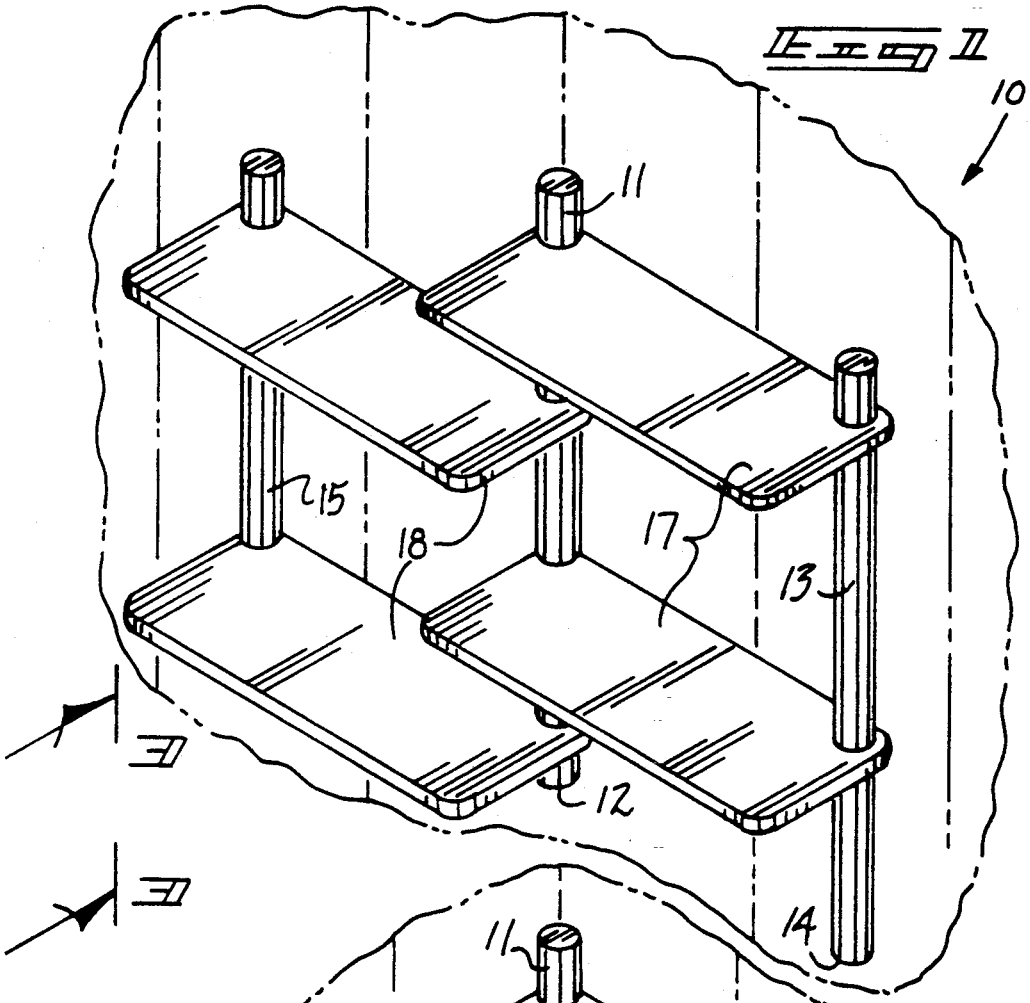
FIG. 1 is an isometric illustration of the instant invention.
Figure 2:
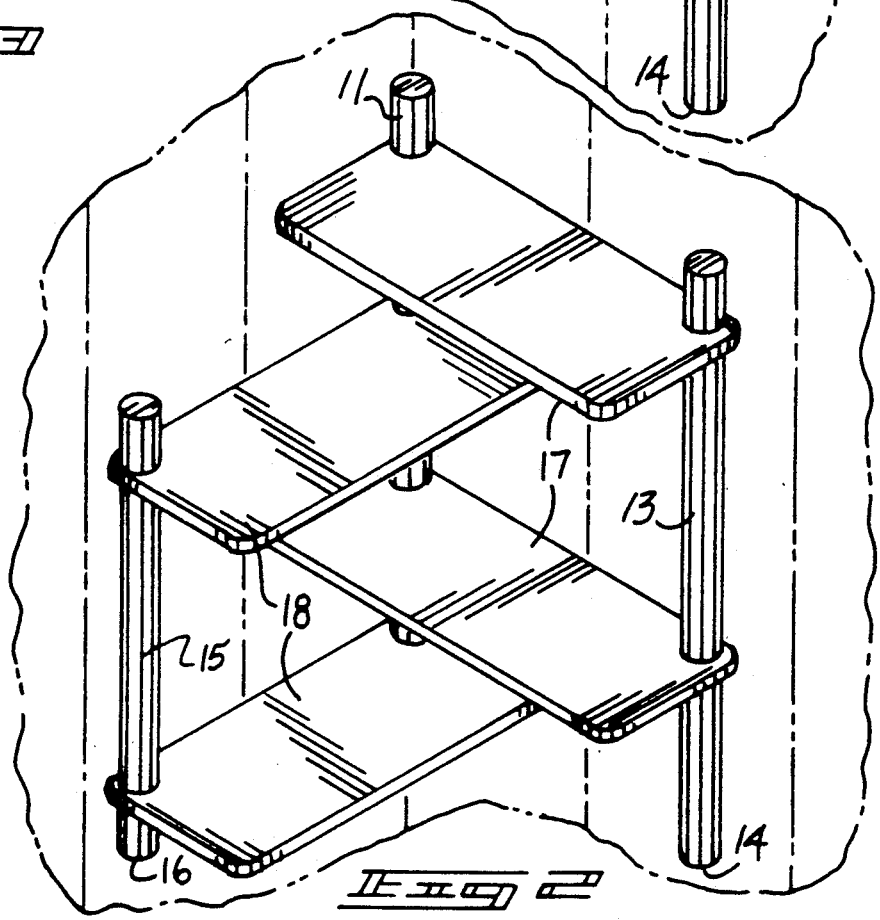
FIG. 2 an isometric illustration of the invention in a second configuration.
Figure 3:
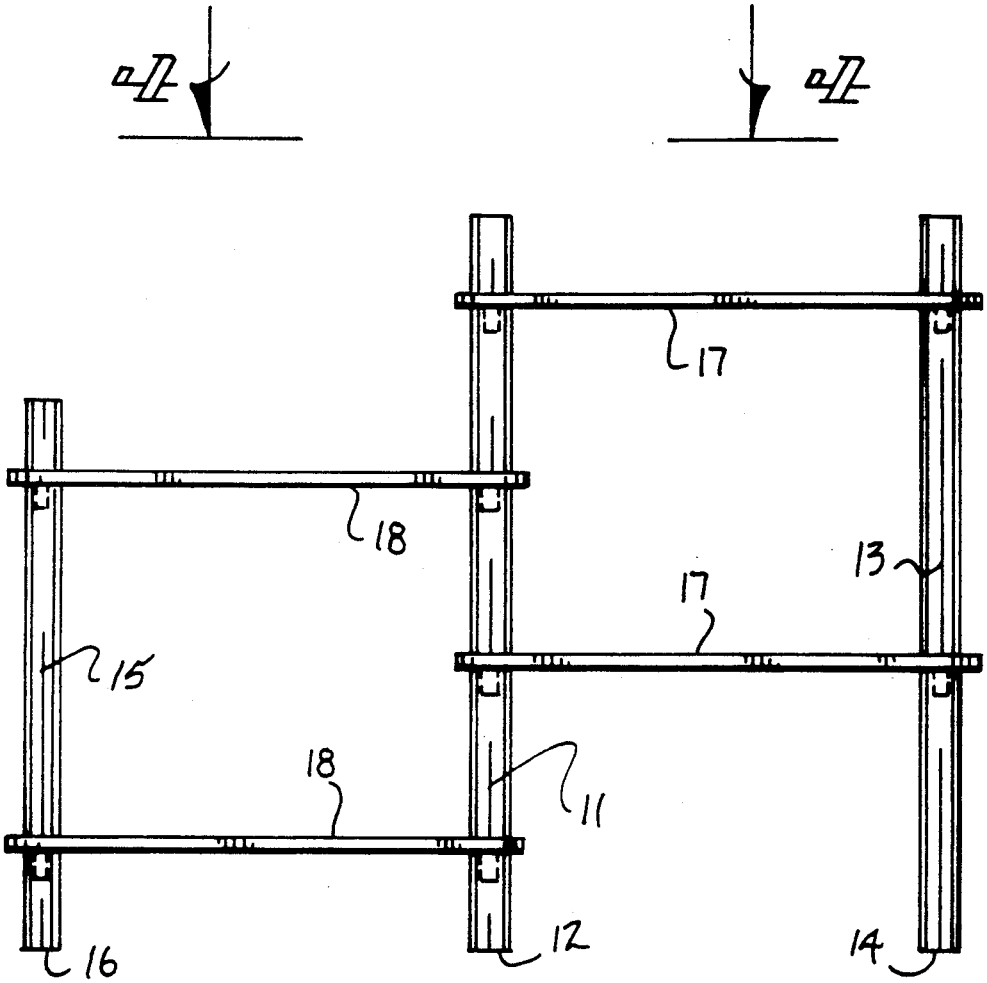
FIG. 3 is an orthographic view of the instant invention.
Figure 4:
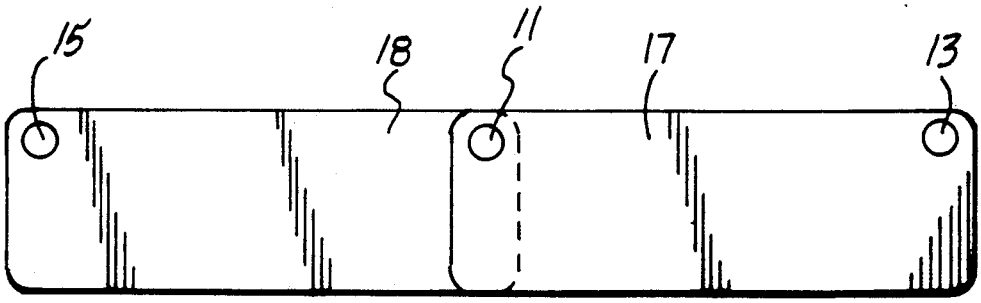
FIG. 4 is an orthographic view, taken along the lines 4—4 of FIG. 3 in the direction indicated by the arrows.

With reference now to the drawings, and in particular to FIGS. 1 to 10 thereof, a new and improved shelf apparatus embodying the principles and concepts of the present invention and generally designated by the reference numerals 10 and 10*a* will be described.

More specifically, the shelf apparatus 10 of the instant invention essentially comprises a central tubular post 11 oriented parallel relative to respective spaced right and left tubular posts 13 and 15. The central tubular post 11 includes a central post lower distal end face 12, the right tubular post includes a right post lower distal end face 14, the left post including a left post lower distal end face 16, wherein the lower end faces 12, 14, and 16 are arranged in a coplanar relationship relative to one another to permit the organization to be free-standing upon a desired support surface.

p Plurality of first shelf plates 17 arranged in a parallel relationship relative to one another are orthogonally mounted between the central post 11 and the right post 13, the first plates 17 are fixedly mounted to the right post 13 and rotatably mounted about the central post 11. A plurality of second shelf plates 18 orthogonally oriented relative to the central post 11 and the left post 15, the second plates are integrally mounted to the left post 15 and rotatably mounted about the central post 11 in a manner as exemplified in the FIG. 2. In this manner, the shelf structure is parallel relative to one another to accommodate various configurations of wall surfaces.

Figure 5:
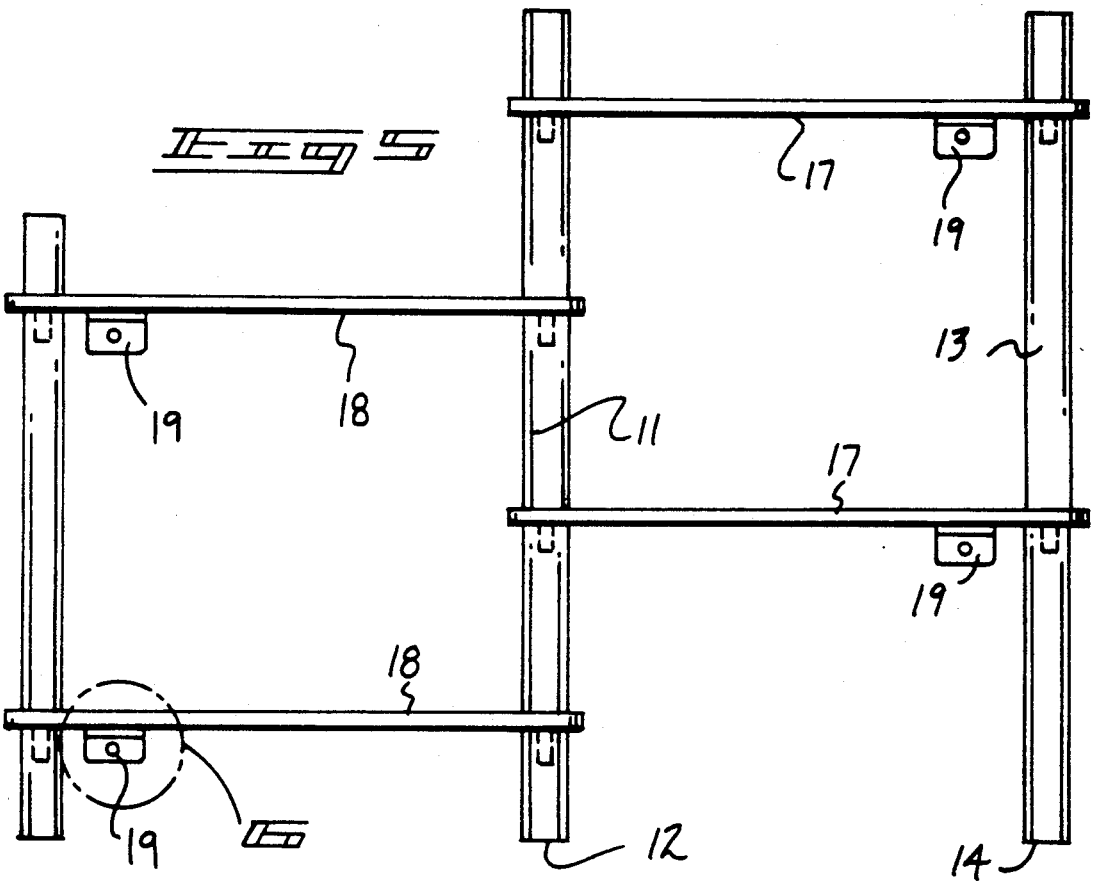
FIG. 5 is an orthographic view of the shelf apparatus employing mounting structure.
Figure 6:
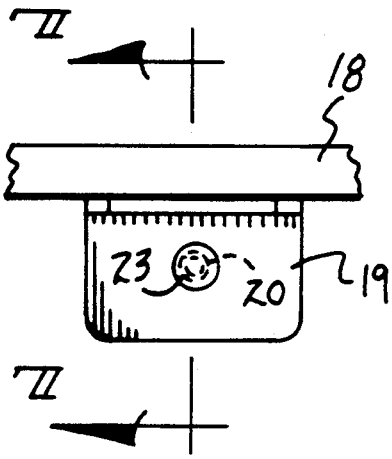
FIG. 6 is an orthographic view of section 6 as set forth in FIG. 5.
Figure 8:
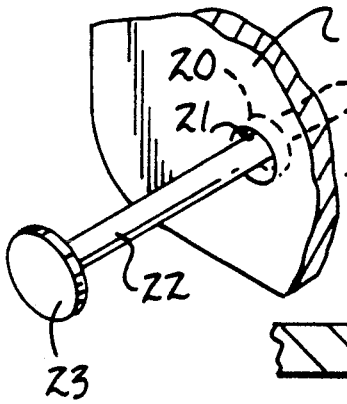
FIG. 8 is an isometric illustration of a fastener member mounted to the mounting structure of the invention.
Figure 7:
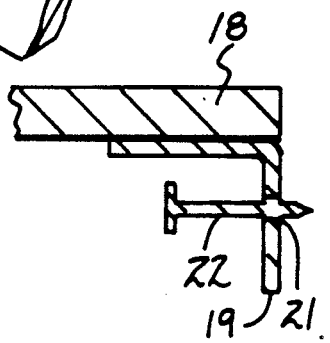
FIG. 7 is an orthographic view, taken along the lines 7—7 of FIG. 6 in the direction indicated by the arrows.

The FIG. 5 illustrates the organization to further include shelf support flanges 19 orthogonally and integrally mounted to bottom surfaces of each of the right and left shelf plates, to include through each support flange 19 a support flange bore 20 orthogonally oriented through each support flange, with each support flange bore 20 including a frangible web 21 mounting a fastener 22 within each bore 20 in a coaxial relationship, wherein each fastener 22 having a head 23 is orthogonally oriented relative to a respective support flange 19. In this manner, the fasteners are properly oriented and mounted, whereupon impact of the fastener head 23 displaces the fastener relative to the associated bore 20 to permit the projection of the associated fastener into a vertical wall surface.

Figure 9:
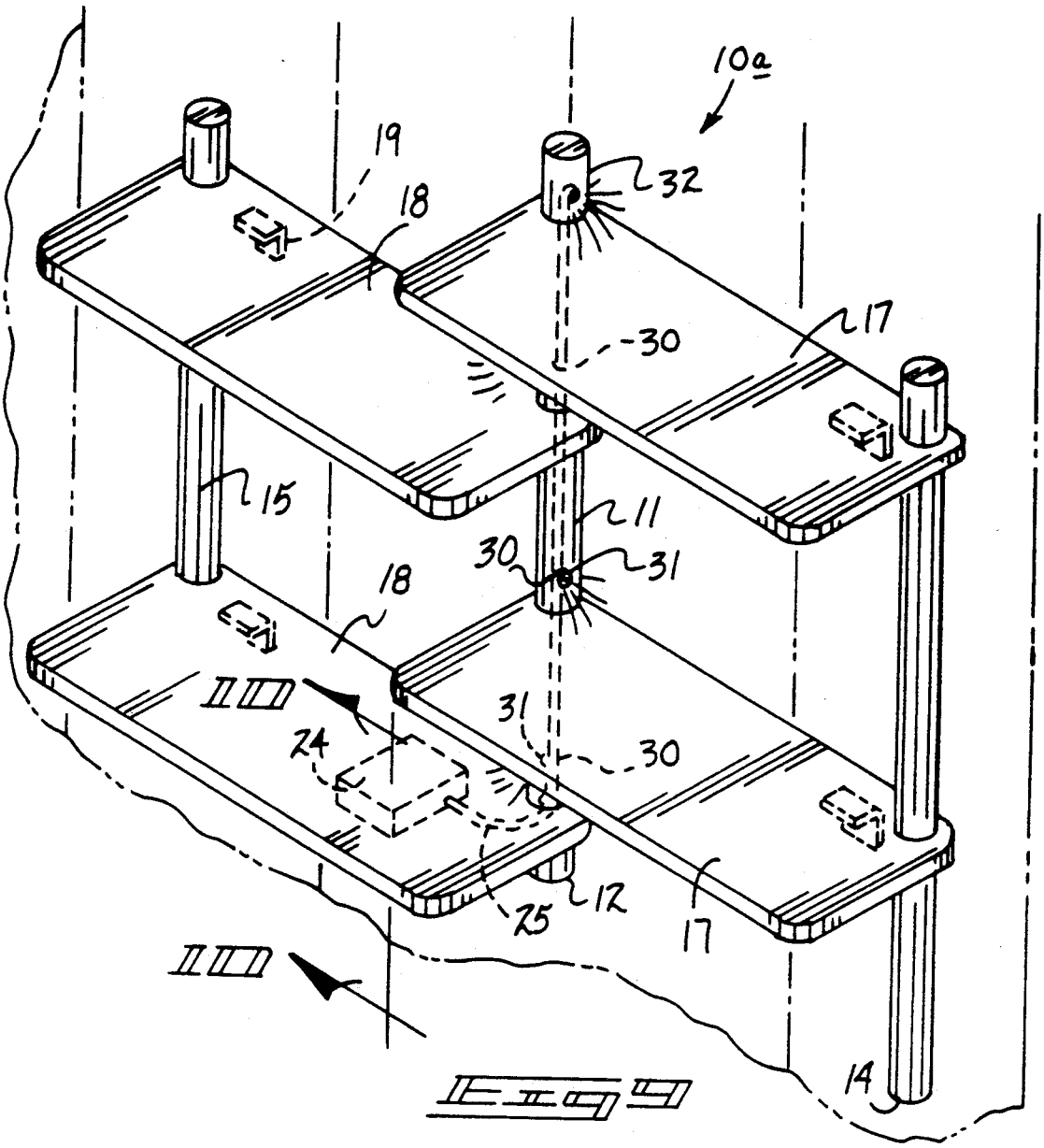
FIG. 9 is an isometric illustration of the invention illustrating illumination means associated therewith.
Figure 10:
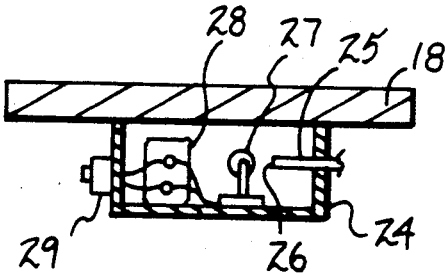
FIG. 10 is an orthographic view, taken along the lines 10—10 of Figure 9 in the direction indicated by the arrows.

The FIG. 9 of the apparatus 10*a* further includes an illumination housing 24 mounted to a bottom surface of one of the left shelf plates 18, or alternatively may be mounted to a bottom surface of a right shelf Plate 17, but it is desirable to mount the illumination housing to a bottom surface of a lowermost shelf structure, as illustrated in FIG. 9. A fiber optic cable 25 including a first end 26 is directed within the housing 24 positioned adjacent an illumination bulb 27 mounted within the housing selectively operative through a battery 28 and an on/off switch 29 to effect selective illumination of the illumination bulb 27 to direct illumination through the fiber optic cable 25 into the first end 26. The fiber optic cable includes a plurality of fiber optic cable junctions 30 having second end portions 31 directed through the central tubular post 11 from the fiber optic cable 25 mounted within the central tubular post to direct illumination upon an associated shelf structure. A fiber optic cable third end 32 is defined at an upper distal end of the fiber optic cable for illumination of an uppermost shelf 17, as illustrated.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A shelf apparatus, the shelf apparatus including a central tubular post, and the central tubular post having a lower distal end face, and a right post spaced from and parallel the central tubular post, and a left post spaced from and parallel the central post, the right post having a right post lower distal end face, the left post having a lower distal end face, and a plurality of first shelf plates rotatably mounted relative to the central tubular post orthogonally oriented relative to the central tubular post, with the first shelf plates fixedly and orthogonally mounted to the right post, and a plurality of second shelf plates spaced from and parallel the first shelf plates are rotatably mounted in an orthogonal relationship about the central tubular post and fixedly mounted in an orthogonal relationship relative to the left tubular post.

2. An apparatus as set forth in claim 1 wherein the central tubular Post lower end face, the right Post lower end face, and the left Post lower end face are arranged in a coplanar relationship.

3. An apparatus as set forth in claim 2 wherein at least one of the respective first and second shelf plates includes a shelf support flange fixedly and orthogonally mounted to a bottom surface thereof, wherein the support flange includes a support flange bore orthogonally directed through the support flange, and the support flange bore includes a frangible web mounted within the support flange bore, the frangible web includes a fastener fixedly secured to the frangible web, with the fastener orthogonally oriented relative to the shelf support flange.

4. An apparatus as set forth in claim 3 wherein a lowermost shelf Plate of said first and second shelf plates includes an illumination housing fixedly mounted to a bottom surface thereof, with the illumination housing including an illumination bulb contained therewithin, and the illumination housing further including a battery contained therewithin, and an on/off switch mounted to the illumination housing to effect selective illumination of the illumination bulb, and a fiber optic cable directed into the illumination housing having a first end positioned adjacent the illumination bulb, and the fiber optic cable directed through the central tubular post.

5. An apparatus as set forth in claim 4 wherein the fiber optic cable includes a plurality of fiber optic cable junctions, wherein each of the junctions includes a fiber optic cable second end portion extending from the junction positioned above one of the first and second shelf Plates, and the fiber optic cable including an upper distal third end spaced above an uppermost shelf of said first and second shelf plates directed towards said uppermost shelf plate.

* * * * *